US007194885B2

(12) United States Patent
Hawkes

(10) Patent No.: US 7,194,885 B2
(45) Date of Patent: Mar. 27, 2007

(54) CONTINUOUS EXTRUSION APPARATUS

(75) Inventor: Daniel J. Hawkes, Shadoxhurst (GB)

(73) Assignee: BWE Limited, Kent (GB)

( * ) Notice: Subject to any disclaimer, the term of this patent is extended or adjusted under 35 U.S.C. 154(b) by 0 days.

(21) Appl. No.: 11/337,811

(22) Filed: Jan. 24, 2006

(65) Prior Publication Data

US 2006/0156782 A1 Jul. 20, 2006

Related U.S. Application Data

(63) Continuation-in-part of application No. 11/200,192, filed on Aug. 10, 2005, now Pat. No. 6,988,389, which is a continuation of application No. PCT/GB2004/00701, filed on Feb. 20, 2004.

(30) Foreign Application Priority Data

Feb. 22, 2003 (GB) ..... 0304114.2

(51) Int. Cl.
*B21C 23/00* (2006.01)

(52) U.S. Cl. ..... 72/262; 72/342.7; 72/481.2

(58) Field of Classification Search ..... 72/253.1, 72/262, 342.1, 342.7, 467, 481.1, 481.2
See application file for complete search history.

(56) References Cited

U.S. PATENT DOCUMENTS

| | | | |
|---|---|---|---|
| 5,133,126 A | 7/1992 | Matsuoka | |
| 5,147,085 A | 9/1992 | Hawkes et al. | |
| 5,152,163 A | 10/1992 | Hawkes et al. | |
| 5,157,955 A | 10/1992 | Hawkes et al. | |
| 5,167,138 A | 12/1992 | Sinha et al. | |
| 5,813,270 A | 9/1998 | Carter | |
| 5,836,191 A | 11/1998 | Wright | |
| 5,887,473 A | 3/1999 | Hawkes | |
| 5,935,476 A | 8/1999 | Langstedt | |
| 6,041,638 A * | 3/2000 | Pinomaa et al. | 72/262 |
| 6,619,093 B2 | 9/2003 | Dawson et al. | |

(Continued)

FOREIGN PATENT DOCUMENTS

| | | |
|---|---|---|
| EP | 0 472 322 A2 | 2/1992 |

(Continued)

OTHER PUBLICATIONS

International Search Report dated Jun. 4, 2004 in International Application No. PCT/GB2004/000701 filed Feb. 20, 2004 with Written Opinion (9 pages).

*Primary Examiner*—Ed Tolan
(74) *Attorney, Agent, or Firm*—Shlesinger, Arkwright & Garvey LLP

(57) ABSTRACT

Continuous extrusion apparatus includes a rotatable wheel, the rotatable wheel including a circumferential groove. Continuous extrusion apparatus includes a shoe including an arcuate tooling bounding a radially outer portion of the groove provided with an exit aperture in a die body and an abutment displaced in the direction of rotation from the exit aperture. The shoe includes a heater body assembly including an electrical induction heating coil assembly arranged to be energisable to co-act with a magnetisable element to effect electrical induction heating thereof; and an element is provided to thermally induce movement of co-acting members for one of expanding and contracting to adjust clearances between the rotatable wheel and the abutment and the shoe within requisite limits.

8 Claims, 2 Drawing Sheets

U.S. PATENT DOCUMENTS

| | | | | |
|---|---|---|---|---|
| 6,655,415 | B2 | 12/2003 | Dawson et al. | |
| 6,871,522 | B2 * | 3/2005 | Maddock et al. | 72/262 |
| 6,988,389 | B2 * | 1/2006 | Hawkes | 72/262 |

FOREIGN PATENT DOCUMENTS

| | | | |
|---|---|---|---|
| GB | 2 364 946 | A | 2/2002 |
| JP | 60-6220 | | 1/1985 |
| JP | 62-289321 | | 12/1987 |
| WO | 00/10750 | A | 3/2000 |
| WO | 01/64363 | A1 | 9/2001 |

* cited by examiner

CONTINUOUS EXTRUSION APPARATUS

CROSS-REFERENCE TO RELATED APPLICATIONS

This application is a continuation-in-part of application Ser. No. 11/200,192, filed Aug. 10, 2005, now U.S. Pat. No. 6,988,389 to Hawkes, issued Jan. 24, 2006, which is a continuation of application no. PCT/GB2004/000701, filed Feb. 20, 2004, now WO 2004/073901 A1 to Hawkes, published 2 Sep. 2004, and which claims priority of United Kingdom application no. 0304114.2, filed Feb. 22, 2003, and each of which is incorporated herein by reference.

FIELD OF THE INVENTION

This invention relates to apparatus for the forming of metals by a continuous extrusion process in which feedstock is introduced into a circumferential groove in a rotating wheel to pass into a passageway formed between the groove and arcuate tooling extending into the groove.

BACKGROUND OF THE INVENTION

WO 2004/073901 discloses continuous extrusion apparatus having a rotatable wheel formed with a circumferential groove, shoe means including arcuate tooling bounding a radially outer portion of the groove provided with an exit aperture in a die body and an abutment displaced in the direction of rotation from the exit aperture, the shoe means being provided with a heater body assembly including an electrical induction heating coil assembly arranged to be energisable to co-act with magnetisable means to effect electrical induction heating thereof.

OBJECTS AND SUMMARY OF THE INVENTION

According to the present invention means are provided to thermally induce movement of co-acting members to expand or contract to adjust clearances between the rotating wheel and the abutment and shoe within requisite limits.

Preferably, the abutment is positioned on a die extension piece seated on a shoulder formed on the shoe and means are provided to induce thermal expansion of the die extension piece to adjust radially the position of the abutment relative to the rotatable wheel.

Relative terms such as left, right, up, and down are for convenience only and are not intended to be limiting.

DETAILED DESCRIPTION OF THE INVENTION

Additionally, the shoe is mounted on a pivot 10 extending parallel to a drive shaft of the rotatable wheel and is urged against an elongated stop block positioned adjacent the rotatable wheel by means of a hydraulic ram bearing against a second shoulder formed on the shoe and means are provided to thermally expand or contract the elongated stop block to adjust the disposition of the shoe in relation to the rotatable wheel.

Figure 1:
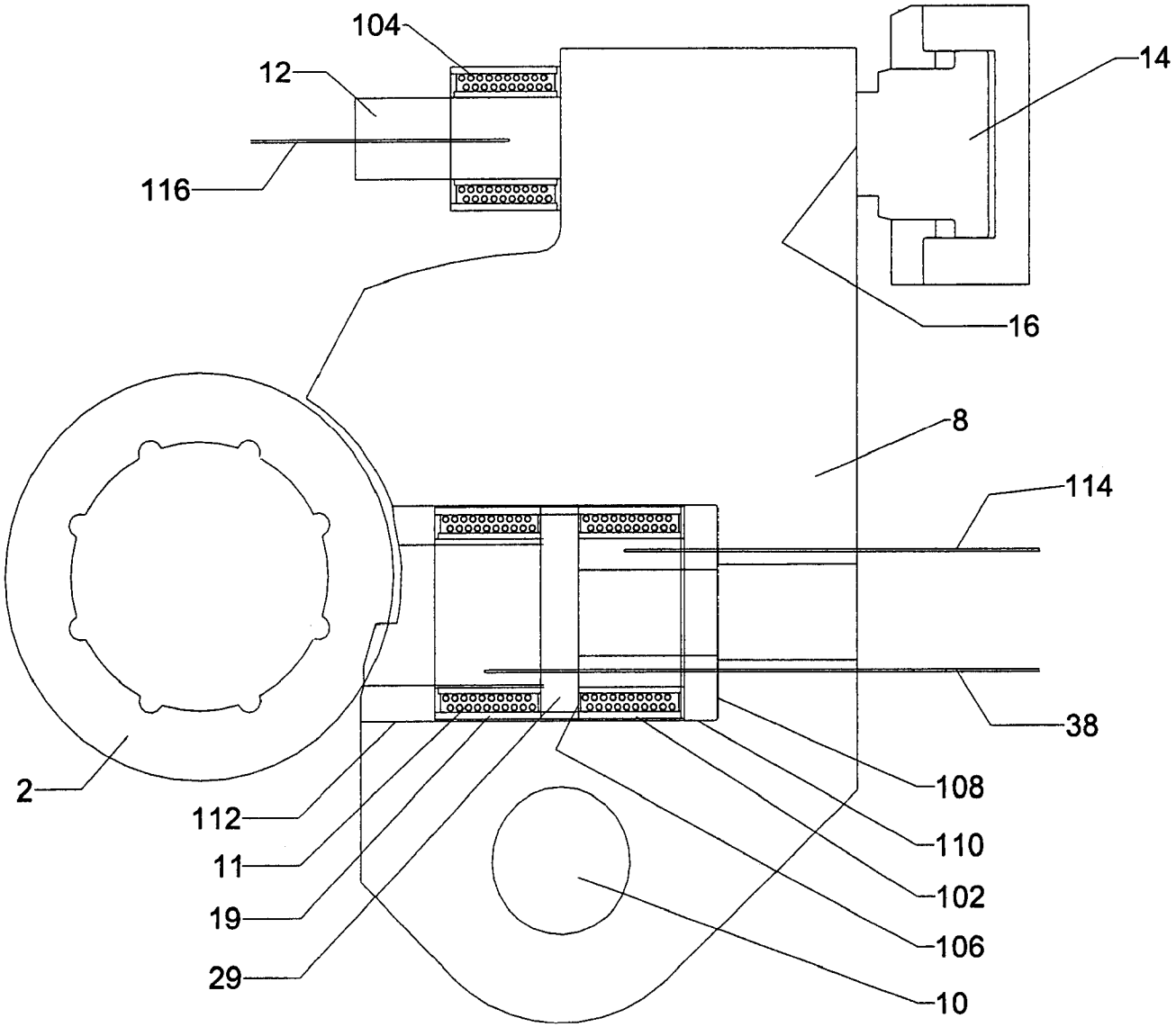
FIG. 1 is a partly diagrammatic, cross-sectional side view of continuous extrusion apparatus including a die heater body assembly 11, together with a die extension piece heater body assembly 102, and a stop block heater body assembly 104 according to the invention.

The invention will now be described, by way of example, in FIG. 1, with reference, in part, to the arrangement of continuous extrusion apparatus described in WO2004/073901 in conjunction with EP-A-0071490 and, in the main, to the accompanying, partly diagrammatic, cross-sectional side view of continuous extrusion apparatus including a die heater body assembly 11 similar to that shown in WO 2004/073901 together with a die extension piece heater body assembly 102 and a stop block heater body assembly 104.

Figure 2:
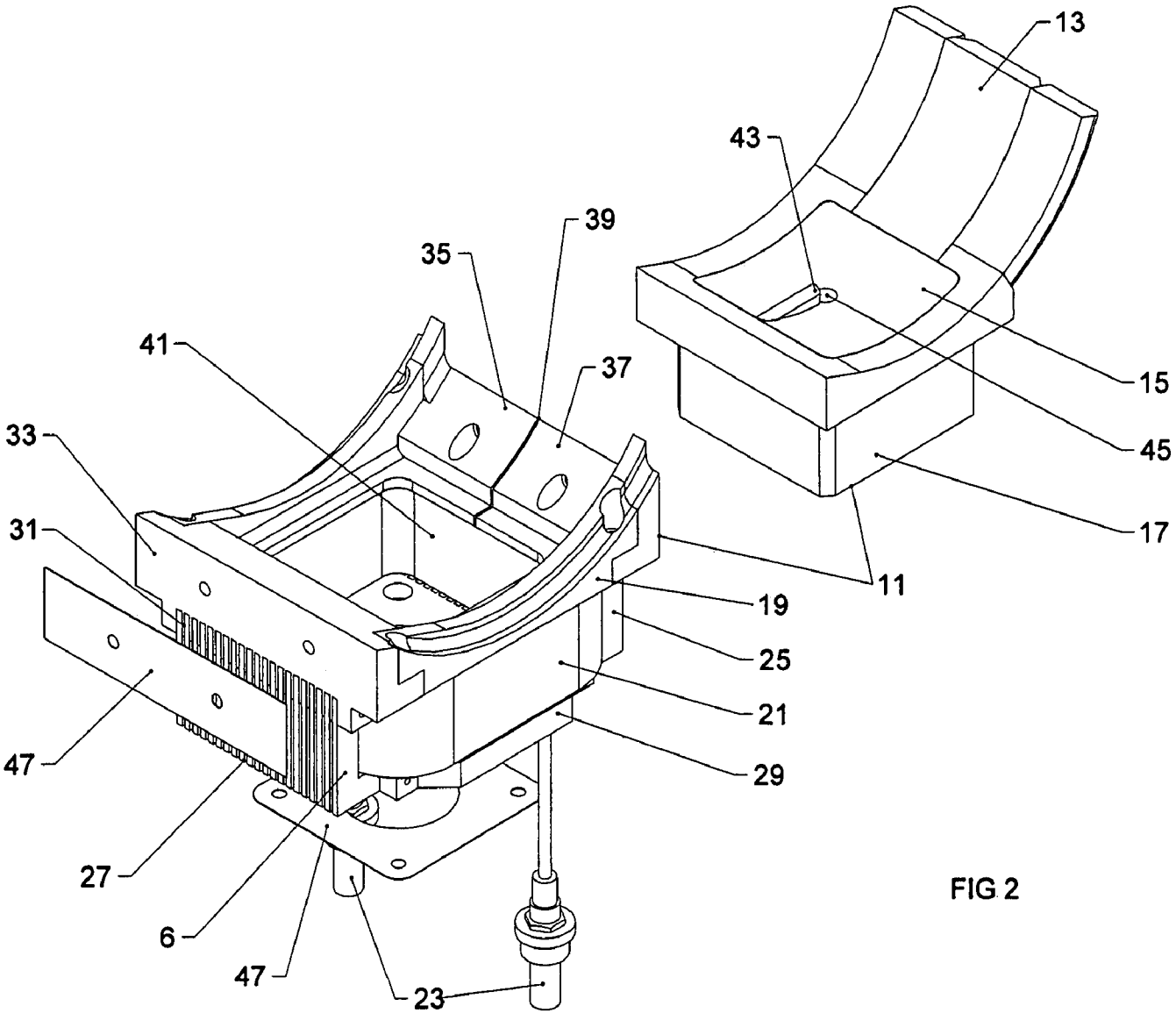
FIG. 2 is a partially exploded perspective view of the die body heater assembly of the continuous extrusion apparatus according to the invention.

FIG. 2 shows the partly diagrammatic, isometric, exploded view of the die body heater assembly described in WO 2004/073901.

The die heater body assembly 11 includes an entry block 13, a die block 15, a centrally apertured bucket portion 17 and a die heater body 19.

The die heater body 19 includes a helical coil of copper tubing set in ceramic support material to form an electrical induction heating coil assembly 21 provided with electric power and cooling water connections 23 extending rearwardly through the shoe. Low reluctance magnetic members 25 are positioned outwardly of the electrical induction heating coil assembly 21 and typically are formed of six millimetre thick stampings 27 of "Silicon-Iron" alloy having a high saturation magnetism and a Curie point in excess of 800° Celsius, spaced apart to form three millimetre gaps, mounted on a centrally apertured base plate 29. End portions 31 of the stampings 27 are connected to first and second magnetic material end blocks 33 and 35 and 37, the second end blocks 35 and 37 being separated by gap 39 to restrict eddy current circulation. A corresponding gap is formed in the base plate 29.

The entry block 13 is formed with the die block 15 of non-magnetic material co-acting with the bucket portion 17 of magnetic material co-acting, in turn, as a sliding fit, with a pocket 41 in the die heater body 19. Dowels (not shown) locate the end blocks 33, 35 and 37 on the shoe means whilst allowing differential thermal expansion. An abutment 43 is positioned on the die block 15 at a location displaced in the direction of rotation from a port 45 leading to a central aperture arranged to receive an extrusion die (not shown), located in the bucket portion 17 of the die block 15.

Thin shims 47 of heat insulating material, such as mica, are positioned intermediate the end block 33, 35 and 37, base plate 29 and the shoe to limit heat transmission to the shoe.

A thermocouple and lead 38 are provided to give a signal indicative of the temperature of the die heater body 19.

The centrally apertured base plate 29 of die heater body assembly 11 seats on a forward end face 106 of the die extension piece heater body assembly 102 which, in turn, seats on a shoulder 108 formed in an extension 110 of the aperture 112 in the shoe housing the die heater body assembly 11. The extension piece heater body assembly 102 is of a generally similar construction to that of the die heater body assembly 11, and is provided with a thermocouple and lead 114.

The shoe 8 is mounted on a pivot 10 extending parallel to a horizontal drive shaft 4 and is urged against a stop 12 positioned adjacent the wheel and above the drive shaft 4 by means of a main hydraulic ram 14 bearing against a shoulder 16 formed on the shoe 8.

A stop block heater body assembly 104 is positioned on the stop block and is of generally similar construction to that of the die heater body assembly 11 and is provided with a thermocouple and lead 116.

In operation, the shoe 8 is pivoted into position abutting the stop 12 and the wheel 2 and fluid supplied to the main hydraulic ram 14 to urge the shoe 8 against the stop 12. The stop block heater body assembly 104 having previously been energised by passing an electrical current at a power level of approximately twelve kilowatts and a frequency of approximately 50 Hertz through the electrical induction heating coil assembly to raise the temperature of the stop block by around 200° C. to thermally expand the stop block 12 to a datum position.

The extension piece heater body assembly 102 is energised by passing an electrical current at a power level of approximately twelve kilowatts and a frequency of approximately 50 Hertz through the electrical induction heating coil assembly to raise the temperature of the extension piece by around 200° C. to thermally expand the extension piece to a datum position.

With the entry block 13, the die block 15 and the bucket portion 17 positioned in the die heater body 19 to form the die heater body assembly 11 and positioned in the shoe of the continuous extrusion apparatus and with copper feedstock being urged to the entry block 13 and die, the bucket portion 17 is inductively heated to a temperature of approximately 700° Celsius by passing an electrical current at a power level of approximately twelve kilowatts and frequency of approximately 50 Hertz through the electrical induction heating coil assembly 21 to maintain the die, by conduction, at a temperature of 700° Celsius, thereby greatly facilitating the extrusion process through the die.

As the extrusion operation proceeds, over time the clearances between the shoe 8 and the wheel 2 vary from the initial settings, so that it is desirable to adjust the clearances to maintain the original settings or a requisite modification thereof without interrupting the extrusion process. To that end, the energy to the extension piece heater body assembly 102 is increased to raise the temperature of the extension piece and produce thermal expansion of the extension piece by an amount sufficient to move the abutment 43 toward the wheel 2, by virtue of the entry block 13 being seated on the face 106 of the extension piece heater body assembly 102 which, in turn, seats on the fixed shoulder 108 in the shoe 8. Decreasing the clearance between the abutment 43 and the wheel 2 toward the original setting reduces the amount of flash material escaping from the gap between the abutment block and the wheel.

The energy to the extension piece heater body assembly 102 is decreased to reduce the temperature of the extension piece and produce thermal contraction of the extension piece by an amount sufficient to move the abutment 43 away from the wheel 2, by virtue of the entry block 13 being seated on the face 106 of the extension piece heater body assembly 102 which, in turn, seats on the fixed shoulder 108 in the shoe 8. Increasing the clearance between the abutment 43 and the wheel 2 toward the original setting increases the amount of flash material escaping from the gap between the abutment block and the wheel.

To counteract movement of the shoe 8 in relation to the wheel 2 as the extrusion process proceeds over time, the heat input to the stop block 12 is reduced or increased by small steps to vary the position of the stop 12 in relation to the wheel 2. Since the operating fluid of the hydraulic ram is maintained at constant pressure, the shoe 8 is urged against the stop 12 and the shape of the gap between the shoe 8 and the wheel 2 is maintained at an optimum disposition to minimise the escape of feed material as flash, since the shoe 8 is rotated about the pivot 10.

The respective thermocouples and leads 38, 114 and 116 are arranged to provide signals indicative of the temperatures of the die body heater assembly 11, the die extension piece heater body assembly 102 and the stop block heater body assembly 104 respectively, which signals may be input into a control system directed toward achieving optimum extrusion conditions.

The amount of flash produced is readily observable visually and by making incremental adjustments to the power inputs to the heater body assemblies 102 and 104 to adjust the associated clearances the formation of flash is thereby adjusted.

In an alternative arrangement, not shown, the die body heater assembly 11 seats directly on a shoulder formed in the aperture 112 in the shoe 8 and is of such a length and of a material having a coefficient of thermal expansion sufficient to give rise to a requisite thermal expansion within the range of operating temperatures of the die block to move the abutment block toward the wheel to maintain a desired clearance between the abutment block and the wheel, thereby minimising the amount of material issuing as flash.

Thus, in operation, the continuous extrusion apparatus is set up and brought up to an operating temperature at the die block of, say, 500° C. and extrusion of copper tube from continuous copper rod feedstock is commenced. As extrusion proceeds, the operating gap between the abutment block and the wheel tends to increase, resulting in an increasing formation of escaping flash material. To counteract the increase, the energy input into the heater block assembly is increased to produce increments in the temperature of the assembly in, say, 20° C. increments such that the resulting thermal expansion of the die body moves the abutment block toward the wheel to restore the gap to the original, predetermined, dimension and thereby limit the amount of flash material produced.

It will be appreciated that, in some circumstances, it will be sufficient to adjust the gap between the abutment and the wheel to restrain the escape of flash material, over time, within acceptable limits, and in such circumstances the heater body assembly associated with the stop block 12 may be omitted.

It further will be appreciated that means other than electric induction heating coils may be utilised to supply or reduce heating to produce the requisite thermal expansion or contraction.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Continuous extrusion apparatus having a rotatable wheel formed with a circumferential groove, shoe means including arcuate tooling bounding a radially outer portion of the groove provided with an exit aperture in a die body and an abutment displaced in the direction of rotation from the exit aperture, the shoe means being provided with a heater body assembly including an electrical induction heating coil assembly arranged to be energisable to co-act with magnetisable means to effect electrical induction heating thereof, wherein means are provided to thermally induce movement of co-acting members to expand or contract to adjust clearances between the rotating wheel and the abutment and shoe within requisite limits.

2. Continuous extrusion apparatus as claimed in claim 1, wherein the abutment is positioned on a die extension piece seated on a shoulder formed on the shoe and means are provided to induce thermal expansion of the die extension piece to adjust radially the position of the abutment relative to the rotatable wheel.

3. Continuous extrusion apparatus as claimed in claim 2 wherein the shoe is mounted on a pivot extending parallel to a drive shaft of the rotatable wheel and is urged against an elongated stop block positioned adjacent the rotatable wheel by means of a hydraulic ram bearing against a second shoulder formed on the shoe and means are provided to thermally expand or contract the elongated stop block to adjust the disposition of the shoe in relation to the rotatable wheel.

4. Continuous extrusion apparatus as claimed in claim 1 wherein the shoe is mounted on a pivot extending parallel to a drive shaft of the rotatable wheel and is urged against an elongated stop block positioned adjacent the rotatable wheel by means of a hydraulic ram bearing against a second shoulder formed on the shoe and means are provided to thermally expand or contract the elongated stop block to adjust the disposition of the shoe in relation to the rotatable wheel.

5. Continuous extrusion apparatus, comprising:

a) a rotatable wheel, the rotatable wheel including a circumferential groove;

b) a shoe, the shoe including an arcuate tooling bounding a radially outer portion of the groove provided with an exit aperture in a die body and an abutment displaced in the direction of rotation from the exit aperture;

c) the shoe including a heater body assembly, the heater body assembly including an electrical induction heating coil assembly arranged to be energisable to co-act with a magnetisable element to effect electrical induction heating thereof; and d) an element being provided to thermally induce movement of co-acting members for one of expanding and contracting to adjust clearances between the rotatable wheel and the abutment and the shoe within requisite limits.

6. Continuous extrusion apparatus as claimed in claim 5, wherein:

a) the abutment is positioned on a die extension piece seated on a first shoulder formed on the shoe; and b) an element is provided to induce thermal expansion of the die extension piece to adjust radially the position of the abutment relative to the rotatable wheel.

7. Continuous extrusion apparatus as claimed in claim 6, wherein:

a) the shoe is mounted on a pivot extending parallel to a drive shaft of the rotatable wheel and is urged against an elongated stop block positioned adjacent the rotatable wheel by a hydraulic ram bearing against a second shoulder provided on the shoe; and b) an element is provided to one of thermally expand and contract the elongated stop block to adjust the disposition of the shoe in relation to the rotatable wheel.

8. Continuous extrusion apparatus as claimed in claim 5, wherein:

a) the shoe is mounted on a pivot extending parallel to a drive shaft of the rotatable wheel and is urged against an elongated stop block positioned adjacent the rotatable wheel by a hydraulic ram bearing against a second shoulder provided on the shoe; and b) an element is provided to one of thermally expand and contract the elongated stop block to adjust the disposition of the shoe in relation to the rotatable wheel.

* * * * *